US009408000B2

(12) United States Patent
Gärtner

(10) Patent No.: US 9,408,000 B2
(45) Date of Patent: Aug. 2, 2016

(54) HEARING INSTRUMENT AND METHOD OF IDENTIFYING AN OUTPUT TRANSDUCER OF A HEARING INSTRUMENT

(71) Applicant: Bernafon AG, Berne (CH)

(72) Inventor: Ivo Gärtner, Lucerne (CH)

(73) Assignee: BERNAFON AG, Berne (CH)

( * ) Notice: Subject to any disclaimer, the term of this patent is extended or adjusted under 35 U.S.C. 154(b) by 211 days.

(21) Appl. No.: 14/107,838

(22) Filed: Dec. 16, 2013

(65) Prior Publication Data

US 2014/0169597 A1 Jun. 19, 2014

Related U.S. Application Data

(60) Provisional application No. 61/737,837, filed on Dec. 17, 2012.

(30) Foreign Application Priority Data

Dec. 17, 2012 (EP) ..... 12197406

(51) Int. Cl.
*H04R 29/00* (2006.01)
*H04R 25/00* (2006.01)

(52) U.S. Cl.
CPC ..... *H04R 25/50* (2013.01); *H04R 25/305* (2013.01); *H04R 25/70* (2013.01); *H04R 2225/61* (2013.01)

(58) Field of Classification Search
CPC ..... H04R 25/305; H04R 25/50
See application file for complete search history.

(56) References Cited

U.S. PATENT DOCUMENTS 5,175,494 A * 12/1992 Yoshimori ..... G01R 31/318335 324/73.1
8,280,086 B2 * 10/2012 Topholm ..... H04R 25/558 381/312
2007/0286441 A1 * 12/2007 Harsch ..... H04R 25/30 381/315
2009/0051368 A1 * 2/2009 Knott ..... H03F 1/52 324/555
2009/0052706 A1 2/2009 Gottschalk et al.
2009/0103754 A1 * 4/2009 Gottschalk ..... H04R 25/305 381/312
2010/0208906 A1 8/2010 Vonlanthen
2011/0002489 A1 * 1/2011 Schefer ..... H04R 25/305 381/312

FOREIGN PATENT DOCUMENTS

WO WO 2007/144010 A1 12/2007
WO WO 2009/006889 A1 1/2009
WO WO 2009/012603 A1 1/2009
WO WO 2009/065742 A1 5/2009
WO WO 2009/134537 A2 11/2009

OTHER PUBLICATIONS

Thomas J. Norton, "Epos ES 14 Loudspeaker", www.stereophile.com, XP055057271, 22 pages, Jun. 28, 1995.

* cited by examiner

*Primary Examiner* — Matthew Eason
*Assistant Examiner* — Taunya McCarty
(74) *Attorney, Agent, or Firm* — Birch, Stewart, Kolasch & Birch, LLP

(57) ABSTRACT

A method for identifying an output transducer of a hearing instrument is disclosed. The method includes applying a pseudo-random signal to the output transducer, receiving a response signal indicative of the impedance of the output transducer, computing a cross-correlation of the response signal and the pseudo-random signal, computing a Fourier transform of the computed cross-correlation, comparing the computed Fourier transform with one or more reference models, and identifying the output transducer based on the comparison.

20 Claims, 3 Drawing Sheets

HEARING INSTRUMENT AND METHOD OF IDENTIFYING AN OUTPUT TRANSDUCER OF A HEARING INSTRUMENT

CROSS REFERENCE TO RELATED APPLICATIONS

This nonprovisional application claims the benefit of U.S. Provisional Application No. 61/737,837 filed on Dec. 17, 2102 and to patent application Ser. No. 12197406.7 filed in the European Patent Office on Dec. 17, 2013. The entire contents of all of the above applications is hereby incorporated by reference.

TECHNICAL FIELD

The disclosure relates generally to hearing instruments, and more particularly to identification of hearing instrument output transducers.

RELATED ART

Hearing instruments, also known as hearing aids or hearing assistance devices are used for overcoming hearing loss. Hearing instruments are available in a variety of configurations depending upon type and severity of hearing loss of a wearer. Hearing instruments are typically matched to the requirement of the wearer, and the severity of the hearing loss of the wearer. Picking a wrong hearing instrument, or using an improperly configured hearing instrument may not provide benefits to the wearer, or may cause further hearing damage to the wearer.

Of particular concern is type and power rating of an output transducer, also known as "receiver", of the hearing instrument. Characteristics of the output transducer should match with other components, such as, a processing unit, and a microphone of the hearing instrument. The output transducer having, for example, an inappropriate power rating can increase the damage to the hearing abilities of the user. Therefore, an accurate selection of an output transducer having characteristics matching the hearing loss pattern of the user and other components of the hearing instruments is required.

Techniques exist in the state of the art for selecting a suitable output transducer for the user. However, existing techniques require applying complete frequency sweeps to the output transducer. Such techniques may require a long time to complete, and may require a large amount of processing power. Further, such techniques may also require an external configuration apparatus for detecting the output transducer connected to the hearing instrument. WO2009065742 A1 discusses a range of such solutions for detecting a type of output transducer and/or for characterizing an output transducer of a hearing instrument. WO2009006889A1 describes a method for identifying a receiver in a hearing aid of the receiver in the ear (RITE) type, the method comprising using the hearing aid to measure the impedance of the receiver, e.g. in connection with a fitting situation.

SUMMARY

According to one aspect, a method for identifying an output transducer of a hearing instrument is disclosed. The method includes applying a pseudo-random signal to the output transducer, and receiving a response signal indicative of the impedance of the output transducer. The method may include generating the pseudo-random signal using a linear feedback shift register. The use of a pseudo-random signal for identifying the output transducer has the advantage that the identification may be made within a very short time period, e.g. about 1 sec., and that the signal applied to the output transducer sounds rather pleasant to the user of the hearing instrument. Identification may thus be made while the user wears the hearing instrument without causing discomfort for the user.

In some implementations, the method may include applying a plurality of pseudo-random signals to the output transducer, and receiving a plurality of response signals corresponding to the plurality of pseudo-random signals. The method may include selecting one of the plurality of response signals and a corresponding one of the pseudo-random signal for computing the cross-correlation. Alternatively, the method may include computing the response signal as a mean of the plurality of response signals. The method may include recording the response signal in the hearing instrument.

The method includes computing a cross-correlation of the response signal and the pseudo-random signal, computing a Fourier transform of the computed cross-correlation, comparing the computed Fourier transform with one or more reference models, and identifying the output transducer based on the comparison (e.g. based on the mean squared error of the Fourier transform of the frequency response relative to the reference model(s)). The one or more reference models may include impedance versus frequency characteristics of one or more known output transducers.

In another aspect, a hearing instrument is disclosed. The hearing instrument may be a receiver in the ear (RITE) type instrument. The hearing instrument includes an output transducer and a signal processing unit. In an embodiment, the signal processing unit is implemented as system on chip (SOC). The signal processing unit (e.g. the SOC) is configured to apply a pseudo-random signal to the output transducer and receive a response signal indicative of the impedance of the output transducer. The signal processing unit (e.g. the SOC) may include a linear feedback shift register to generate the pseudo-random signal.

In some implementations, the signal processing unit (e.g. the SOC) may apply a plurality of pseudo-random signals to the output transducer, and receive a plurality of response signals corresponding to the plurality of pseudo-random signals. The signal processing unit (e.g. the SOC) may then select one of the plurality of response signals and a corresponding one of the pseudo-random signal for computing the cross-correlation. Alternatively, the signal processing unit (e.g. the SOC) may compute the response signal as a mean of the plurality of response signals. The signal processing unit (e.g. the SOC) may include a memory unit to record the response signal in the hearing instrument.

The signal processing unit (e.g. the SOC) is further configured to compute a cross-correlation of the response signal and the pseudo-random signal, and compute a Fourier transform of the computed cross-correlation. The signal processing unit (e.g. the SOC) is still further configured to compare the computed Fourier transform with one or more reference models, and identify the output transducer based on the comparison. The signal processing unit (e.g. the SOC) may include a memory unit to store the one or more reference models.

The hearing instrument may also include an analog to digital converter (ADC), a sense resistor having a first lead and a second lead, wherein the first lead is electrically coupled to an input of the analog to digital converter, and the second lead is electrically coupled to a ground (or fixed potential) terminal of the hearing instrument (e.g. the signal processing unit, e.g. the SOC); and a switching unit. The switching unit may be configured to disconnect a (e.g. negative) lead of the output transducer from a (e.g. negative) operating output pin of the signal processing unit (e.g. the SOC); place the negative operating output pin of the signal processing unit (e.g. the SOC) in a high impedance state; and connect a (e.g. the negative) lead of the output transducer to the input of the analog to digital converter and the first lead of the sense resistor.

The term 'identify the output transducer' is in general taken to refer to the problem of identifying different types of output transducers, but may also refer to the identification of individual output transducer properties. A type of output transducer can e.g. be defined by its intended technical specifications, such as its input sensitivity and/or max output volume. The individual output transducer properties is on the other hand taken to refer to a unique identification of the individual receiver (such as its individual detailed frequency response). The type of receiver may e.g. be identified indirectly buy extracting a 'code' (e.g. by reading from an ID-chip or by measuring a resistance of an ID-resistor located on the output transducer (or a connecting cable or connector)) from the output transducer in question (cf. e.g. WO2009065742 A1). The reliability of this indirect identification of type is tied to the process of applying a 'code' (ID-chip, electronic component, etc.) to a particular output transducer. The output transducer properties (as e.g. represented by the impedance measurement of the present disclosure) are by nature measured directly on the output transducer in question and thus as reliable as the measurement allows.

In an embodiment, the output transducer or a cable or connector for connecting the output transducer to the signal processing unit comprises an identification (ID) resistor having a resistance indicative of the type of output transducer and wherein the hearing instrument is configured to measure said resistance and compare it to a number of predefined resistances indicative of respective different types of output transducers and to identify the type of output transducer presently connected to the hearing instrument based on the comparison. In an embodiment, the sense resistor is or comprises the ID resistor.

In an embodiment, the value of the sense resistor is measured by the ADC and used to identify the type of output transducer by comparing with predefined sensor resistances for other types of output transducers. A simultaneous (subsequent or preceding) measurement of the impedance of the output transducer (i.e. e.g. the impedance of a coil system of the output transducer) as described in the present disclosure may be used to increase the confidence in the measurement of type (whereby each measurement may be less precise, and thus easier to implement) and/or to further characterize the particular output transducer in question by its specific properties (by identifying its particular (frequency dependent) impedance).

In an embodiment, the hearing instrument comprises a user interface allowing an initiation of the identification of the output transducer and/or a presentation of the result of the identification of the output transducer. In an embodiment, the user interface is implemented on a remote control device for controlling functionality of the hearing instrument. In an embodiment, the user interface is implemented (e.g. as an APP) on a SmartPhone, e.g. using a touch sensitive screen.

In an embodiment, the hearing instrument is configured to perform a self diagnosis including performing the identification of the output transducer at each power on of the hearing instrument and/or on demand of a user (either the user of the hearing instrument via a user interface, or the user of a fitting system via a programming interface).

In an embodiment, the hearing instrument is configured to detect mechanical damages in the output transducer based on the comparison of the computed Fourier transform with the one or more reference models (e.g. based on stored values of typical thresholds for deviations from typical values, e.g. related to peak total harmonic distortion (THD)). In an embodiment, the hearing instrument is configured to detect such mechanical damage detection at each power on of the hearing instrument and/or on demand of a user.

In an embodiment, the hearing instrument further includes a transducer identification output configured to produce one or more of an audible signal, a visible signal, or an electrical signal indicating the type of output transducer connected, based on the identification.

In yet another aspect, a computer program product for identifying an output transducer is disclosed. The computer program product includes a non-transitory computer readable medium with computer readable code stored thereon comprising computer executable instructions. The computer executable instructions cause a processor to apply a pseudo-random signal to the output transducer. The computer program product may include computer executable instructions to cause the processor to generate the pseudo-random signal using a linear feedback shift register.

The computer executable instructions cause the processor to receive a response signal indicative of the impedance of the output transducer. Further, the computer program product may include computer executable instructions to cause the processor to apply a plurality of pseudo-random signals to the output transducer, and receive a plurality of response signals corresponding to the plurality of pseudo-random signals. The computer program product may include computer executable instructions to either select one response signal of the plurality of response signals and a corresponding one of the pseudo-random signals for computing the cross-correlation, or to compute the response signal as a mean of the plurality of response signals.

The computer executable instructions cause the processor to compute a cross-correlation of the response signal and the pseudo-random signal; compute a Fourier transform of the computed cross-correlation; compare the computed Fourier transform with one or more reference models; and identify the output transducer based on the comparison.

The computer program product may also include computer executable instructions to cause the processor to record the response signal in a memory unit.

The embodiments described herein may advantageously enable output transducer identification, in-situ in the hearing instrument, may consume less time than prior techniques, and may require much less processing power than prior techniques.

In the present context, a "hearing instrument" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A "hearing instrument" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear.

A hearing instrument may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. A hearing instrument may comprise a single unit or several units communicating electronically with each other.

More generally, a hearing instrument comprises an input transducer for receiving an acoustic signal from a user's surroundings and providing a corresponding input audio signal and/or an input receiver for electronically receiving an input audio signal, a signal processing circuit for processing the input audio signal and an output means for providing an audible signal to the user in dependence on the processed audio signal. Some hearing instruments may comprise multiple input transducers, e.g. for providing direction-dependent audio signal processing. In some hearing instruments, the input receiver may be a wireless receiver. In some hearing instruments, the input receiver may be e.g. an input amplifier for receiving a wired signal. In some hearing instruments, an amplifier may constitute the signal processing circuit. In some hearing instruments, the output means may comprise an output transducer, such as e.g. a loudspeaker for providing an air-borne acoustic signal or a vibrator for providing a structure-borne or liquid-borne acoustic signal. In some hearing instruments, the output means may comprise one or more output electrodes for providing electric signals.

In some hearing instruments, the vibrator may be adapted to provide a structure-borne acoustic signal transcutaneously or percutaneously to the skull bone. In some hearing instruments, the vibrator may be implanted in the middle ear and/or in the inner ear. In some hearing instruments, the vibrator may be adapted to provide a structure-borne acoustic signal to a middle-ear bone and/or to the cochlea. In some hearing instruments, the vibrator may be adapted to provide a liquid-borne acoustic signal in the cochlear liquid, e.g. through the oval window. In some hearing instruments, the output electrodes may be implanted in the cochlea or on the inside of the skull bone and may be adapted to provide the electric signals to the hair cells of the cochlea, to one or more hearing nerves and/or to the auditory cortex.

A "hearing system" refers to a system comprising one or two hearing instruments, and a "binaural hearing system" refers to a system comprising two hearing instruments and being adapted to cooperatively provide audible signals to both of the user's ears. Hearing systems or binaural hearing systems may further comprise "auxiliary devices", which communicate with the hearing instruments and affect and/or benefit from the function of the hearing instruments. Auxiliary devices may be e.g. remote controls, remote microphones, audio gateway devices, mobile phones (e.g. SmartPhones), public-address systems, car audio systems or music players. Hearing instruments, hearing systems or binaural hearing systems may e.g. be used for compensating for a hearing-impaired person's loss of hearing capability, augmenting or protecting a normal-hearing person's hearing capability and/or conveying electronic audio signals to a person.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawings, wherein.

DETAILED DESCRIPTION

In the following description, reference is made to the accompanying figures, which show by way of illustration how the invention may be practiced.

Figure 1:
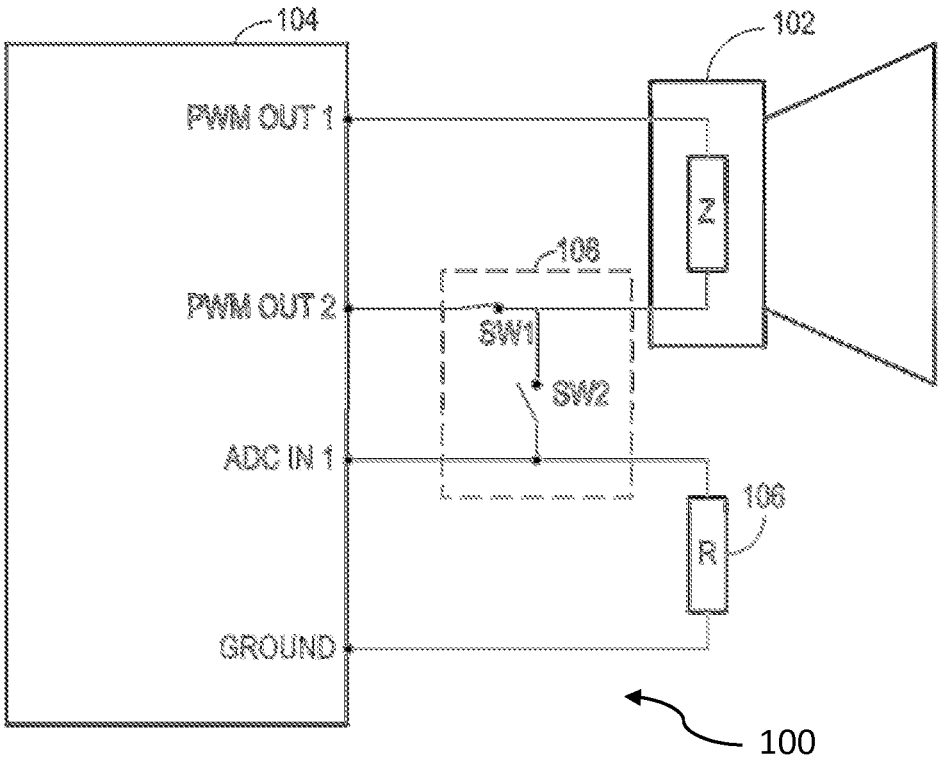
FIG. 1 illustrates an exemplary hearing instrument according to one embodiment.

FIG. 1 illustrates an exemplary hearing instrument 100, according to one embodiment. The hearing instrument 100 includes an output transducer 102, a signal processing unit (e.g. implemented as a system on chip (SOC); The signal processing unit is in the following denoted SOC) 104, a pull down resistor 106, and a switching unit 108. The hearing instrument 100 may also include a microphone (not shown), in various embodiments. The hearing instrument 100 may be configured to amplify and condition the sound signals picked up by the microphone, and present the amplified and conditioned sound signals to the wearer, through the output transducer 102.

The output transducer 102 may be any device that converts electrical signals into acoustic signals (or to signals or stimuli perceived by a user as acoustic signals). The output transducer 102 includes a driver, such as an electromagnetic or piezoelectric driver to convert electrical signals into acoustic signals. The output transducer 102 may be a speaker with a speaker cone or diaphragm. The speaker projects sound waves into the ear canal of the wearer. Alternatively, the output transducer 102 may be a bone conduction device. The bone conduction device converts electrical signals into mechanical vibrations through the driver. The bone conduction device couples the mechanical vibrations produced by the driver directly to the bones of the skull, such as the temple bones, or the cheek bones.

The hearing instrument 100 may include a different type of output transducer 102, based on the severity of hearing loss of the wearer. For example, the output transducer 102 may be a standard transducer (S-receiver), a medium-power transducer (M-receiver), or a power transducer (P-receiver), indicating respectively, a standard power output, a medium power output, and a high power output. The standard transducer may be used by wearers suffering from light hearing loss. The medium-power transducer may be used by wearers suffering moderate to high hearing loss. The power transducer may be used by wearers suffering from severe hearing loss.

The SOC 104 is configured to perform signal processing for the hearing instrument 100, and provide interfacing of various components of the hearing instrument 100 with each other, as well as interfacing the hearing instrument 100 with external devices such as, but not limited to, a programming and configuration system, telephone receivers and public address systems (for example, via a T-loop or other near-field magnetic induction communication link, or Bluetooth® links, and the like), and so forth. The SOC 104 may operate in a hearing assistance mode, or a transducer identification mode. An exemplary SOC 104 is described in conjunction with FIG. 3.

In the hearing assistance mode, the SOC 104 may be configured to function as a hearing instrument, i.e. to receive signals picked up by the microphone (not shown), amplify, filter and/or otherwise modify the received signals, and drive the output transducer 102 with the modified signals. The SOC 104 converts the acoustic signals picked up by the microphone into electrical signals. The SOC 104 then amplifies, filters and/or otherwise modifies the electrical signals. The SOC 104 may be configured to perform amplification and/or other modification of the electrical signals based on the severity of hearing loss of the wearer, and the type of output transducer 102 of the hearing instrument 100. For example, for light hearing loss the SOC 104 may be configured to amplify the electrical signals with a standard gain, for moderate hearing loss the SOC 104 may be configured to amplify the electrical signals with a medium gain, while for severe hearing loss the SOC 104 may be configured to amplify the electrical signals with a high gain. The gains of SOC 104 may be frequency-dependent and programmed into one or more gain maps stored onboard the SOC 104. The gain maps of the SOC 104 may be designed based on the various types of output transducer 102 capable of being used in the hearing instrument 100. For example, the SOC 104 may have different gain maps for S-receivers, M-receivers, and P-receivers. Further, the SOC 104 may have multiple different gain maps for a single type of output transducer. For example, the SOC 104 may have multiple gain maps for a P-receiver, based on the severity of hearing loss of the wearer. Such multiple gain maps allow for fine tuning of the hearing instrument 100 for optimal benefit to the wearer of the hearing instrument 100.

In the transducer identification mode, the SOC 104 may be configured to detect the output transducer 102 connected to the SOC 104. The SOC 104 may be configured to apply a pseudo-random signal to the output transducer 102. The SOC 104 may use a linear-feedback shift register (LFSR) to generate the pseudo-random signal. Using linear-feedback shift registers to generate pseudo-random bit sequences is well known in the art (see e.g. FIG. 4). A linear-feedback shift register generally comprises a shift register in which the contents of some or all of the shift register cells are combined with each other, e.g. using exclusive or (XOR) operations, and used as input to the shift register. When the linear-feedback shift register is clocked, the output repeatedly traverses a pseudo-random bit sequence. The length of the pseudo-random signal may be chosen in dependence on the different types of output transducers to identify. In an embodiment, a shift register of length five is used to generate the pseudo-random signal, and 16 shifts of the shift register are performed. In some embodiments, the SOC 104 may convert the pseudo-random bit sequence or the pseudo-random signal to an analog pseudo-random signal using a digital to analog converter (DAC), and apply the analog pseudo-random signal to an amplifier, such as a class-D amplifier. In some embodiments, the SOC 104 may convert the pseudo-random bit sequence generated by the linear-feedback shift register signal directly to corresponding output voltage levels to the output transducer, e.g. via an amplifier. The SOC 104 may then apply the amplified analog pseudo-random signal to the output transducer 102, through any of the PWM output pins of the SOC 104. The SOC 104 may apply a single pseudo-random signal to the output transducer 102, apply multiple instances of the single pseudo-random signal to the output transducer 102 at defined time intervals, or apply multiple distinct pseudo-random signals to the output transducer 102 at defined time intervals. The pseudo-random signal applied to the output transducer 102 is preferably chosen such that it comprises frequencies with a wide frequency band. Thus, frequency-dependent differences in the impedances of the different types of output transducers 102 will reflect themselves in the response signals.

In the transducer identification mode, the SOC 104 may also be configured to receive a response signal indicative of the impedance of the output transducer 102, for output transducer detection. The SOC 104 may receive the response signal at an ADC input pin of the SOC 104. The SOC 104 may be configured to receive the response signal for a defined time interval after the SOC 104 has applied the pseudo-random signal to the output transducer 102. The defined time interval for receiving the response may be based on typical impulse response decay of various output transducers. The SOC 104 may then digitize the response signal. The SOC 104 may digitize the response signal with the same time resolution as the pseudo-random signal—or a finer time resolution. Thus, the SOC 104 obtains a digital response signal having at least the same length as that of the applied pseudo-random signal. In other words, if the SOC 104 has transmitted an N-sample pseudo-random signal, the SOC 104 may be configured to perform a digitization of N or more samples of the response signal. The time resolution and the bit resolution may be chosen in dependence on the different types of output transducers to identify. In an embodiment, 16 samples are received and recorded. pseudorandom noise (PN) sequence may alternatively have any length, but should be minimized to reduce the discomfort of the user, e.g. to 32 bits or less or 128 bits or less.

In the transducer identification mode, the SOC 104 is further configured to compute a cross-correlation of the response signal and the pseudo-random signal. The SOC 104 is configured to perform the cross-correlation on the digital response signal and the applied pseudo-random signal. In one embodiment, the SOC 104 may be configured to compute the cross-correlation as a multiply-and-sum of the digital response signal and the pseudo-random signal. In other words, the SOC 104 may multiply the individual bits of the digital response signal with the corresponding bits of the pseudo-random signal, and compute the sum of the resulting bits, to obtain the cross-correlation. The SOC 104 may perform multiply-and-sum of the digital response signal with each shift of the pseudo-random signal. A plot of the cross-correlation results versus time shift yields a substantially accurate approximation of the impulse response of the output transducer 102.

In the transducer identification mode, the SOC 104 is further configured to compute a Fourier transform of the computed cross-correlation. The SOC 104 may compute the Fourier transform using a fast Fourier transform (FFT) algorithm. The SOC 104 may use any known FFT algorithm, such as, but not limited to, the Cooley-Tukey FFT algorithm, the prime factor FFT algorithm, Bruun's FFT algorithm, Rader's FFT algorithm, Bluestein's FFT algorithm, and the like. The FFT of the computed cross-correlation (which in turn, is an approximation of the impulse response of the output transducer 102) yields the frequency response of the output transducer 102. The frequency response of the output transducer 102 represents the curve of impedance of the output transducer 102 at different frequency bins.

The frequency response of different output transducers may be different, depending on the construction of the output transducer. The frequency response may be dictated by the behavior of the output transducer at different frequencies. The impedance, and thus the frequency response, of the output transducer may depend on factors such as the construction of the driver coil, the type of magnets used in the output transducer, dimensions of a piezoelectric driver, and so forth. The frequency response of various types of output transducers, such as S-receivers, M-receivers, and P-receivers, may be known, for example, by prior testing, knowledge of construction details, prior simulations or measurements, and so forth. The frequency response of the various output transducers may be stored as reference models. The SOC 104 may be configured to store the reference models within an onboard memory.

In the transducer identification mode, the SOC 104 compares the computed FFT with the reference models, and identifies the output transducer 102 based on the comparison. The closest match between the computed FFT and a reference model of a particular output transducer results in a positive identification of the output transducer 102 (e.g. using a criterion based on the least mean squared error). For example, if the SOC 104 determines that the computed FFT best or closest matches the reference model of a P-receiver, the SOC 104 indicates that the output transducer 102 is a P-receiver. In performing such a comparison, the SOC 104 compares the frequency response of the output transducer 102 (which is the FFT of the cross-correlation of the response signal with the pseudo-random signal), with the frequency response of known output transducers. The SOC 104 may also be configured to produce an electrical signal indicating the type of output transducer connected, based on the identification. In some embodiments, the electrical signal may cause the hearing instrument 100 to produce one or more of a vibration, an audible signal, and a visible signal. Preferably, the hearing instrument itself (or a remote control application of a separate device, e.g. a SmartPhone) can thereby indicate the result of the identification of the output transducer. In an embodiment, the signal processing unit, e.g. the SOC, may be configured to transfer the result of the identification (or the measured frequency response) to another device (e.g. to a fitting system or a remote control device, e.g. a SmartPhone), e.g. via the program interface (or another wired or wireless interface) for presentation, storage and/or further processing at or by such other device.

To operate the SOC 104 in the transducer identification mode, the hearing instrument 100 includes the sense resistor 106, and the switching unit 108. The sense resistor 106 may be a resistor having a precisely known value of resistance, and having low sensitivity to change in thermal and electrical conditions of the hearing instrument 100. A precisely known value of the sense resistor 106 aids in accurate digitization of the signal at the ADC input. A first lead of the sense resistor is electrically coupled to the input of the ADC of the SOC 104, and the second lead of the sense resistor is electrically coupled to the ground terminal of the SOC 104, for example via a switch (not shown).

The switching unit 108 includes switches SW1 and SW2. The switch SW1 of the switching unit 108 is configured to disconnect a negative lead of the output transducer 102 from a negative operating pin (PWM out 2) of the SOC 104. The switch SW1 of the switching unit 108 is also configured to place the negative operating pin (PWM out 2) of the SOC 104 in a high impedance state. In other words, the switch SW1 is capable of floating the PWM OUT 2 pin of the SOC 104. The switch SW2 of the switching unit 108 is configured to connect the negative lead of the output transducer 102 to the input of the ADC, and to the first lead of the sense resistor 106 which is also electrically coupled to the input of the ADC. In the hearing assistance mode, the switching unit 108 closes the switch SW1 and opens the switch SW2. In the transducer identification mode, the switching unit 108 opens the switch SW1 and closes the switch SW2. Although discrete switches SW1 and SW2 are illustrated in FIG. 1, it should be appreciated that any other switch arrangement may be implemented to have the same functionality as that provided by switches SW1 and SW2 of the switching unit 108. The switching unit 108 may be a mechanically activated switching mechanism having mechanical switches or jumpers, or may be an electronically actuated switching circuit having, for example, relays, transistor switches, and so forth. In one embodiment, the switching unit 108 may be configured to be controlled by the SOC 104.

Figure 2:
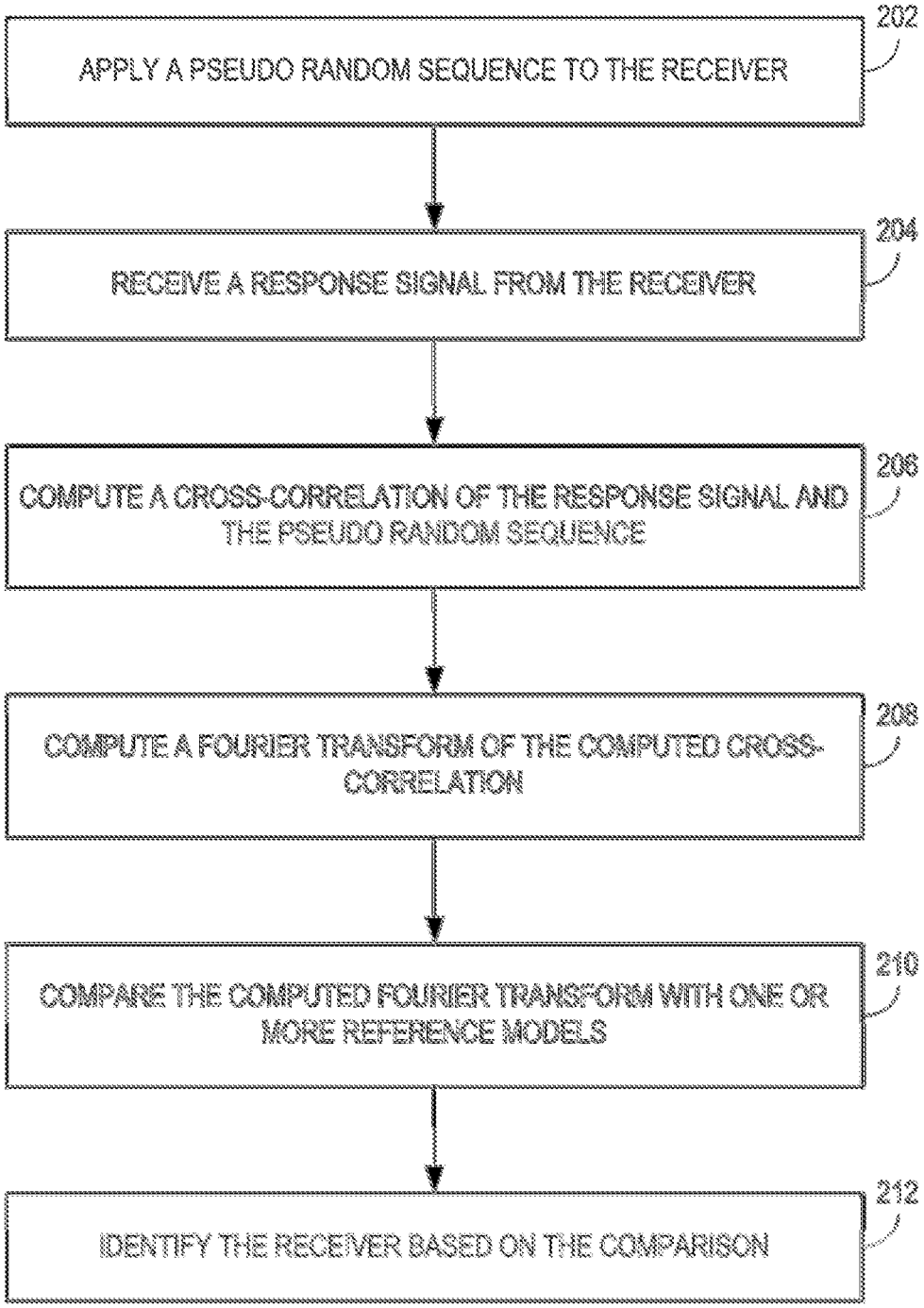
FIG. 2 illustrates a flowchart of an exemplary method for identifying an output transducer of a hearing instrument, according to one embodiment.

FIG. 2 illustrates a flowchart of an exemplary method for identifying an output transducer of a hearing instrument, according to one embodiment.

At step 202, the SOC 104 applies a pseudo-random signal to the output transducer 102. In various embodiments, the SOC 104 may apply a plurality of pseudo-random signals to the output transducer 102. The SOC 104 may apply multiple instances of the same pseudo-random signal to the output transducer 102. Alternatively, the SOC 104 may apply distinct cyclically shifted versions of the pseudo-random signal to the output transducer 102. In the implementations where the SOC 104 applies a plurality of pseudo-random signals, the SOC 104 may apply successive pseudo-random signals after defined timed intervals. The defined time intervals may be based on expected time duration for the impulse response of the output transducer 102 to decay substantially. The pseudo-random signal is preferably applied to the output transducer 102 at a relatively low amplitude in order reduce the discomfort to the user and avoid damaging the user's hearing.

At step 204, the SOC 104 receives a response signal indicative of the impedance of the output transducer 102. The SOC 104 may record or store the response signal in a memory onboard the hearing instrument 100. In the implementations where the SOC 104 applies a plurality of pseudo-random signals, the SOC 104 receives a plurality of response signals, each corresponding to individual ones the of pseudo-random signals. The SOC 104 may record or store the response signal in the memory onboard the hearing instrument 100.

At step 206, the SOC 104 computes a cross-correlation of the response signal and the pseudo-random signal. The cross-correlation of the response signal and the pseudo-random signal yields a substantially accurate approximation of the impulse response of the output transducer 102. In the implementation where the SOC 104 applies a plurality of different pseudo-random signals, thus receiving a plurality of response signals, the SOC 104 may select one of the plurality of response signals and the corresponding pseudo-random signal for computing the cross-correlation. Alternatively, the SOC 104 may compute the cross-correlations of each pair of pseudo-random signal and corresponding response signal, to obtain multiple cross-correlations. In another such implementation, where the SOC 104 applies multiple instances of the same pseudo-random signal, the SOC 104 may first compute the response signal as a mean of the plurality of response signals. The SOC 104 may then compute the cross-correlation of the computed response signal. In an embodiment, four or even more responses are received and used for computing one or more cross-correlations.

At step 208, the SOC 104 computes a Fourier transform of the computed cross-correlation. In various implementations, the SOC 104 may compute the Fourier transform using an FFT algorithm. Computing the Fourier transform of the computed cross-correlation (which is in turn the impulse response of the output transducer 102), yields the frequency response of the output transducer 102. In the implementation where the SOC 104 applies a plurality of different pseudo-random signals and computing multiple cross-correlations, the SOC 104 may compute the Fourier transform of each of the multiple cross-correlations, and then compute a mean of the multiple Fourier transforms to obtain a mean frequency response for comparison with the reference. models. If a multiple instances of the same pseudo-random signal is applied to the output transducer, and if the record length of the cross-correlation is longer than the impulse response of the output transducer, an appropriate 'cut' of the recorded cross-correlation vs. time has to be performed. Preferably, the ratio in which the impulse response is being cut is chosen to provide that the ratio of samples before and after the cross-correlation main lob (or peak) is $1/\sqrt{2}$, rounded to whole numbers, of course. So more bits after the main lob than before it.

At step 210, the SOC 104 compares the computed Fourier transform with one or more reference models. The hearing instrument 100 may have the reference models stored on an onboard memory. The reference models represent the frequency response i.e. the impedance versus frequency characteristics of known output transducers.

At step 212, the SOC 104 identifies the output transducer based on the comparison. The SOC 104 may indicate the output transducer based on a close match between the computed Fourier transform and a particular reference model. A variety of methods may be used for comparing frequency responses against a reference. One such method is e.g. to choose the one that has the least mean squared error of the frequency response to the reference.

Figure 3:
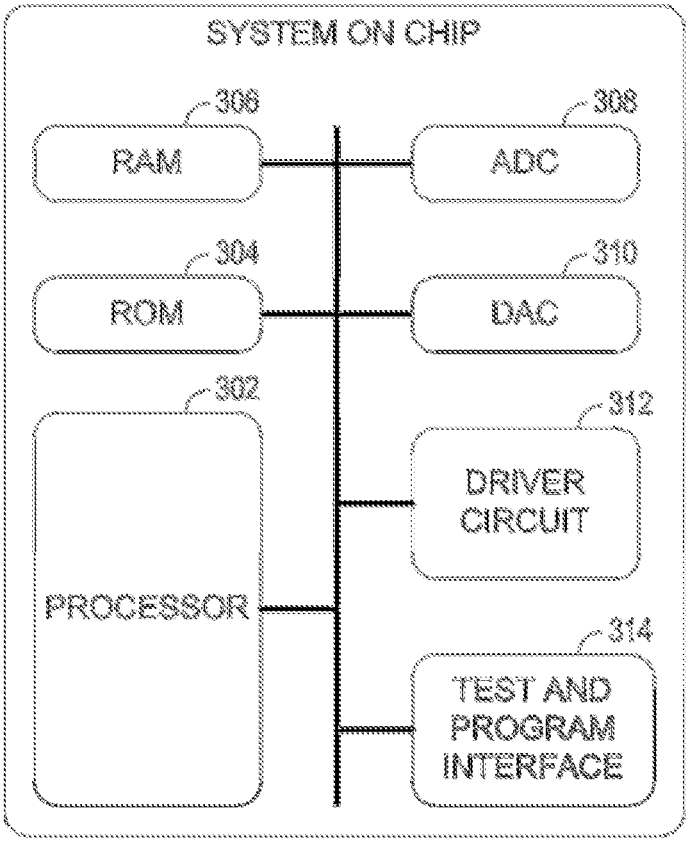
FIG. 3 illustrates a simplified block diagram of an exemplary system on chip according to one embodiment.

FIG. 3 illustrates a simplified block diagram of an exemplary signal processing unit, e.g. in the form of a system on chip (SOC) 104, according to one embodiment. The SOC 104 includes a processor 302, a read only memory (ROM) 304, a random access memory (RAM) 306, an analog to digital converter (ADC) 308, a digital to analog converter (DAC) 310, a driver circuit 312, and a test and program interface 314.

The processor 302 is configured to execute computer executable instructions of a computer program code. The processor 302 is configured to perform operations such as signal processing, noise reduction, filtering, generating pseudo-random signals, computing cross-correlation, computing Fourier transforms using FFT algorithms, comparing reference models and computed FFT, and controlling the operation of the hearing instrument 100. The processor 302 may include an arithmetic and logic unit (ALU), and a control unit (CU). The processor 302 may be a reduced instruction set computing (RISC) processor, or a complex instruction set computing (CISC) processor. Example processors include, without limitation, the Cortex™ core by ARM® Holdings, Keystone™ digital signal processors by Texas Instruments®, OMAP™ processors by Texas Instruments, an application specific processor dedicated to performing signal processing in a hearing aid, and the like. The processor 302 executes computer executable instructions of a computer readable code stored in, for example, the ROM 304, or the RAM 306.

The ROM 304 is configured to store computer readable code including computer executable instructions that the processor 302 may execute. The ROM 304 is further configured to store the reference models of known output transducers. The ROM 304 may be one of known solid state memories, such as programmable ROM (PROM), erasable programmable ROM (EPROM), electrically erasable programmable ROM (EEPROM), flash ROM, and so forth. The ROM 304 may be programmed through the test and program interface 314.

The RAM 306 is e.g. a high speed volatile semiconductor memory. The RAM 306 temporarily stores the computer readable code for fast access by the processor 302. At startup of the hearing instrument 100, the processor 302 may respond to a boot signal wherein the computer readable program code stored in the ROM 304 is copied to the RAM 306. Further, the RAM 306 may also be configured to store or record the response signals. The RAM 306 may be a static RAM (SRAM) or a dynamic RAM (DRAM). Further, the RAM 306 may be a single data rate (SDR) RAM, configured to perform read or write operations only once per clock cycle, or a double data rate (DDR) RAM, configured to perform read or write operations twice per clock cycle.

The hearing instrument, e.g. the signal processing unit may further comprise a non-volatile, writeable memory allowing a log of data to be stored and relied on by the hearing instrument at a later point in time and/or to be transferred to another device, e.g. a fitting system or programming device or remote control device, e.g. via the program interface 314.

The ADC 308 is configured to perform analog to digital conversion of analog signals applied to the ADC input pin of the SOC 104, and provide the digital signal to the other components of the SOC 104. The ADC 308 may be one of, a direct conversion ADC, a successive approximation ADC, a sigma-delta ADC, a ramp compare ADC, a delta-encoded ADC, and so forth. Other types of ADC implementations may also be employed in the SOC 104.

The DAC 310 is configured to perform digital to analog conversion of digital signals for application to an analog external circuit, such as the output transducer 102. For example, the DAC 310 may convert the digital pseudo-random signal generated by the processor 302 to an analog signal, for applying to the output transducer 102. In various implementations, the DAC 310 may provide the analog signal to the driver circuit 312 for driving the output transducer 102.

The driver circuit 312 is configured to amplify the signals processed by the SOC 104 for external transmission. The driver circuit 312 then provides the amplified signal to the output transducer 102. The driver circuit 312 may include a class D amplifier, also known as a switching amplifier.

The test and program interface 314 may be used to interface the SOC 104 with an external testing equipment for testing the hearing instrument 100, or with an external chip programming device for programming the SOC 104. The test and program interface 314 may be a known interface such as a Joint Test Action Group (JTAG) interface, or an I2C interface, a serial port, and so forth.

Figure 4:
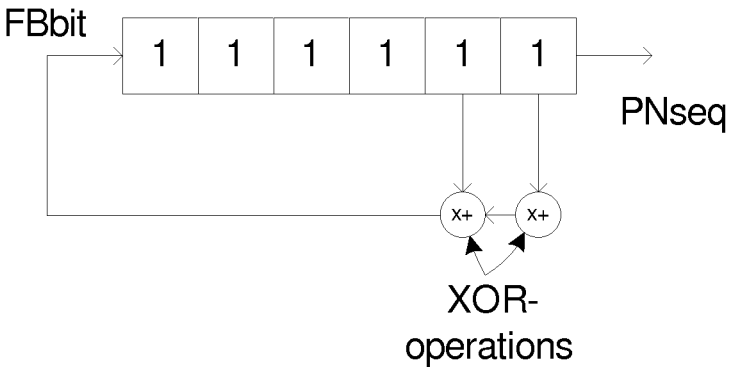
FIG. 4 illustrates an exemplary (prior art) circuit for producing a pseudo-random signal based on a linear feedback shift register (LFSR).

FIG. 4 shows an example of a known circuit for producing a pseudo-random signal based on linear feedback shift register (LFSR). The function can e.g. be implemented as a digital circuit or as software (e.g. as part of the signal processing unit, e.g. the SOC). The squares ('1') represent the register itself, the ones defining the current state of each respective register element. At the initialization of the register, it contains (in the present example) all "1"s; however, it could be any state apart from all "0"s.

The feedback is made by extracting some of the states in the register and make an exclusive or addition of all of them. Feedback is the result from the XOR operation. The output of the last XOR unit (denoted 'x+') is fed into the first bit of the register (signal FBit). The corresponding generator polynomial for each register length (and therefore sequence length) can e.g. be derived from text books on digital communication, e.g. "Proakis, John G., Digital Communications, Third edition, New York, McGraw Hill, 1995". The output of the last shift register element represents the pseudo-random sequence (signal PNseq).

The clock source of the LSFR is the analogue/digital converter's word clock, so an output bit is created for every input sample. This is e.g. of importance to the provision of a correct timing.

To drive the pseudorandom noise (PN) sequence to the output, the 1's and 0's can e.g. be mapped to a digital level for the PWM stage, e.g. 0x00000000 and 0x00100000.

The method of measuring the impedance of an output transducer according to the present disclosure can also be used to detect mechanical damages in the output transducer itself. The damage from mechanical shock has an impact on the membranes suspension, e.g. in that it makes it softer or it rips off at all. This causes measurable changes in the impedance around the resonance frequency of the output transducer.

The difference between impedances of a damaged and un-damaged output transducer between 3-4 kHz is clearly recognizable and may e.g. exhibit a peak total harmonic distortion (THD) of 15% or more.

In other words, depending on the type of output transducer, a mechanical damage will cause a change in the impedance in a certain frequency range. This frequency range and the order of magnitude of the impedance change is preferably evaluated for each speaker type of cause, since the mechanics are not the same. The feature would be also applicable for BTE and ITE styles, since they can be dropped to the floor as well.

In an embodiment, an output transducer type is identified by the impedance measurement according to the present disclosure. In case the hearing instrument detects a deviation of the impedance measurement from an expected value, an indication to such fact by the hearing instrument is provided.

In an embodiment, a self diagnosis of the hearing instrument including an impedance measurement is performed at each power on of the hearing instrument and/or on demand of a user. Preferably, the deviation of the impedance measurement from an expected value (e.g. larger than a threshold) triggers an indication by the hearing instrument and/or in the fitting software when the hearing instrument is connected to a fitting system (to prompt the audiologist to make a verification measurement on the output transducer).

In a particular embodiment, an output transducer type is identified by the impedance measurement according to the present disclosure in combination with a measurement of a resistance of an ID-resistor specific for a given output transducer type. In such embodiment, the resistor measurement (cf. e.g. WO2009065742 A1) can be used to identify the type of receiver, whereas the output transducer measurement can be used to detect a deviation from a normal impedance, which may be due to damage, and thus should result in a change of output transducer.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method for identifying an output transducer of a hearing instrument, the method comprising:

applying a pseudo-random signal to the output transducer;

receiving a response signal indicative of the impedance of the output transducer;

computing a cross-correlation of the response signal and the pseudo-random signal;

computing a Fourier transform of the computed cross-correlation;

comparing the computed Fourier transform with one or more reference models; and identifying the output transducer based on the comparison.

2. The method of claim 1, wherein the output transducer is a receiver in the ear (RITE) type output transducer.

3. The method of claim 1 further comprising:

generating the pseudo-random signal using a linear feedback shift register.

4. The method of claim 1 further comprising:

applying a plurality of pseudo-random signals to the output transducer;

receiving a plurality of response signals corresponding to the plurality of pseudo-random signals; and selecting one of the plurality of response signals and a corresponding one of the pseudo-random signal for computing the cross-correlation.

5. The method of claim 1 further comprising:

applying a plurality of instances of the pseudo-random signal to the output transducer;

receiving a plurality of response signals corresponding to the plurality of instances of the pseudo-random signal; and computing the response signal as a mean of the plurality of response signals.

6. The method of claim 1 further comprising:

recording the response signal in the hearing instrument.

7. The method of claim 1, wherein the one or more reference models comprise impedance versus frequency characteristics of one or more known output transducers.

8. A hearing instrument comprising:

an output transducer; and a signal processor configured to:

apply a pseudo-random signal to the output transducer;

receive a response signal indicative of the impedance of the output transducer;

compute a cross-correlation of the response signal and the pseudo-random signal;

compute a Fourier transform of the computed cross-correlation;

compare the computed Fourier transform with one or more reference models; and identify the output transducer based on the comparison.

9. The hearing instrument of claim 8, wherein the hearing instrument is a receiver in the ear (RITE) type instrument.

10. The hearing instrument of claim 8, wherein the signal processor further comprises a linear feedback shift register to generate the pseudo-random signal.

11. The hearing instrument of claim 8, wherein the signal processor is further configured to:

apply a plurality of pseudo-random signals to the output transducer;

receive a plurality of response signals corresponding to the plurality of pseudo-random signals; and select one of the plurality of response signals and a corresponding one of the pseudo-random signal for computing the cross-correlation.

12. The hearing instrument of claim 8, wherein the signal processor is further configured to:

apply a plurality of instances of the pseudo-random signal to the output transducer;

receive a plurality of response signals corresponding to the plurality of instances of the pseudo-random signal; and compute the response signal as a mean of the plurality of response signals.

13. The hearing instrument of claim 8 further comprising a memory configured to:

record the response signal; and store the one or more reference models.

14. The hearing instrument of claim 8 further comprising:

an analog to digital converter;

a sense resistor having a first lead and a second lead, wherein the first lead is electrically coupled to an input of the analog to digital converter, and the second lead is electrically coupled to a ground terminal of the signal processor; and a switching switch unit configured to:

disconnect a negative lead of the output transducer from a negative operating output pin of the signal processor;

place the negative operating output pin of the signal processor in a high impedance state; and connect the negative lead of the output transducer to the input of the analog to digital converter and the first lead of the sense resistor.

15. The hearing instrument of claim 8 further comprising a transducer identification output configured to produce one or more of an audible signal, a visible signal, or an electrical signal indicating the type of output transducer connected, based on the identification.

16. The hearing instrument of claim 8 further comprising a user interface allowing an initiation of said identification of the output transducer and/or a presentation of the result of the identification of the output transducer.

17. The hearing instrument of claim 16 wherein the user interface is implemented on a remote control device or a SmartPhone.

18. The hearing instrument of claim 8 wherein the output transducer or a cable or connector for connecting the output transducer to the signal processor comprises an identification resistor having a resistance indicative of the type of output transducer and wherein the hearing instrument is configured to measure said resistance and compare it to a number of predefined resistances indicative of respective different types of output transducers and to identify the type of output transducer presently connected to the hearing instrument based on the comparison.

19. The hearing instrument of claim 8 configured to perform a self diagnosis including performing the identification of the output transducer at each power on of the hearing instrument and/or on demand of a user.

20. The hearing instrument of claim 8 configured to detect mechanical damages in the output transducer based on the comparison of the computed Fourier transform with the one or more reference models.

* * * * *